US006347969B1

(12) United States Patent
Takahashi

(10) Patent No.: US 6,347,969 B1
(45) Date of Patent: Feb. 19, 2002

(54) COOLING SYSTEM FOR OUTBOARD MOTOR

(75) Inventor: Masanori Takahashi, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/558,311

(22) Filed: Apr. 25, 2000

Related U.S. Application Data

(62) Division of application No. 08/995,681, filed on Dec. 22, 1997, now Pat. No. 6,053,784.

(30) Foreign Application Priority Data

Dec. 20, 1996 (JP) ..... 8-341813

(51) Int. Cl.[7] ..... B63H 21/38
(52) U.S. Cl. ..... 440/88; 12/41.08; 12/41.14
(58) Field of Search ..... 440/88, 89; 123/41.08, 123/41.14

(56) References Cited

U.S. PATENT DOCUMENTS

| | | | | |
|---|---|---|---|---|
| 3,908,579 A | | 9/1975 | Miller et al. | |
| 4,399,797 A | | 8/1983 | Iwai | |
| 4,588,385 A | | 5/1986 | Suzuki et al. | |
| 4,604,069 A | | 8/1986 | Taguchi | |
| 4,857,023 A | | 8/1989 | Takashima | |
| 4,976,462 A | | 12/1990 | Hirata et al. | |
| 4,991,546 A | | 2/1991 | Yoshimura | |
| 4,997,399 A | | 3/1991 | Makayasu et al. | |
| 5,009,622 A | | 4/1991 | Dudney | |
| 5,036,804 A | | 8/1991 | Shibata | |
| 5,330,376 A | | 7/1994 | Okumura | |
| 5,334,063 A | | 8/1994 | Inoue et al. | |
| 5,487,688 A | | 1/1996 | Sumigawa | |
| 5,555,855 A | | 9/1996 | Takahashi | |
| 5,628,285 A | | 5/1997 | Logan et al. | |
| 5,713,771 A | | 2/1998 | Takahashi et al. | |
| 5,769,038 A | | 6/1998 | Takahashi et al. | |
| 5,904,605 A | * | 5/1999 | Kawasaki et al. | 440/88 |
| 6,053,784 A | * | 4/2000 | Takahaski | 440/88 |

* cited by examiner

*Primary Examiner*—Sherman Basinger
(74) *Attorney, Agent, or Firm*—Ernest A. Beutler

(57) ABSTRACT

A cooling system for an outboard motor having a water propulsion device and an internal combustion engine positioned in a cowling, the engine having an output shaft arranged to drive the water propulsion device, is disclosed. The cooling system includes a coolant delivery mechanism driven by the engine, the delivery mechanism arranged to deliver coolant selectively to at least one of two coolant jackets of the engine. One coolant jacket is associated with at least one combustion chamber of the engine. The other cooling jacket is associated with an exhaust manifold for that combustion chamber. The cooling system also includes at least one coolant drain line through which coolant may drain from each of the cooling jackets of the engine.

7 Claims, 2 Drawing Sheets

COOLING SYSTEM FOR OUTBOARD MOTOR

CROSS REFERENCE TO RELATED APPLICATION

This application is a division of my application of the same title, Ser. No. 08/995681, filed, Dec. 22, 1997 now U.S. Pat. No. 6,053,784, and assigned to the assignee hereof.

FIELD OF THE INVENTION

The present invention relates to a cooling system. More particularly, the invention is an improved cooling system for an outboard motor having a water propulsion device powered by an internal combustion engine.

BACKGROUND OF THE INVENTION

As is well known, outboard motors for use in powering watercraft include an engine powering a water propulsion apparatus of the motor, such as a propeller. These outboard motors have a cowling, which encloses the engine.

The motor is generally movably mounted to a stern of a watercraft, and as such, it is desirable that the motor be compact in dimension. Keeping the motor compact reduces air drag and reduces the force necessary to turn or trim the motor. In order that the outboard motor be small in dimension, the engine is arranged to be as compact as possible, and the cowling is sized to fit just around the engine.

The positioning of the engine in the small space defined by the cowling is beneficial when considering the above-stated goals, but creates several problems. A main problem is that the cowling traps significant heat generated by the engine.

Therefore, it has been a common practice to provide cooling for at least some or all of the exhaust system in addition to the cooling for the cylinders. Various arrangements have been proposed for communicating these cooling systems with each other but a particular problem arises in that the coolant for the outboard motor is generally taken directly from the body of water in which the watercraft is operating. Thus, the question of thermal shock is particularly important, principally in connection with the cooling of the cylinder block and cylinder head.

Arrangements have been provided for providing various types of flow patterns through the engine and its exhaust system but these have not been totally successful in meeting the diverse needs of these two parts of the engine.

It is, therefore, a principal object of this invention to provide an improved cooling system for an outboard motor engine wherein the exhaust and engine cylinder cooling are controlled so that the, needs of each can be more accurately controlled.

It is a further object of this invention to provide an improved flow control arrangement for such a diverse cooling system for an outboard motor.

An improved cooling system for an outboard motor having a water propulsion device powered by an internal combustion engine is desired.

SUMMARY OF THE INVENTION

In accordance with the present invention, there is provided a cooling system for an outboard motor. Preferably, the motor is of the type, which has a powerhead comprising an internal combustion positioned in a cowling. The motor includes a water propulsion device which is powered by the engine. The engine has an engine body assembly defining at least one cylinder. An induction system delivers at least an air charge to the cylinder and an exhaust system discharges a burnt charge from the cylinder to the atmosphere. The engine further comprises an output shaft arranged to drive the water propulsion device. The cooling system including a coolant delivery mechanism driven by the engine for drawing water from a body of water in which the outboard motor is operating and returning the drawn water back to the body of water. The cooling system comprises a first cooling path for cooling the cylinder and a second cooling paths for cooling the exhaust. The delivery mechanism is arranged to deliver coolant through the second cooling path and to a coolant drain. The delivery mechanism is also arranged to deliver coolant through the first cooling path to the coolant drain. Means control the flow of coolant from the engine through the first and second paths comprising first and second control valves disposed at respective downstream ends of the first and said second cooling paths for controlling the respective flow therethrough.

Further objects, features, and advantages of the present invention over the prior art will become apparent from the detailed description of the drawings, which follows, when considered with the attached figures.

DETAILED DESCRIPTION OF THE PREFERRED EMBODIMENTS OF THE INVENTION

Figure 1:
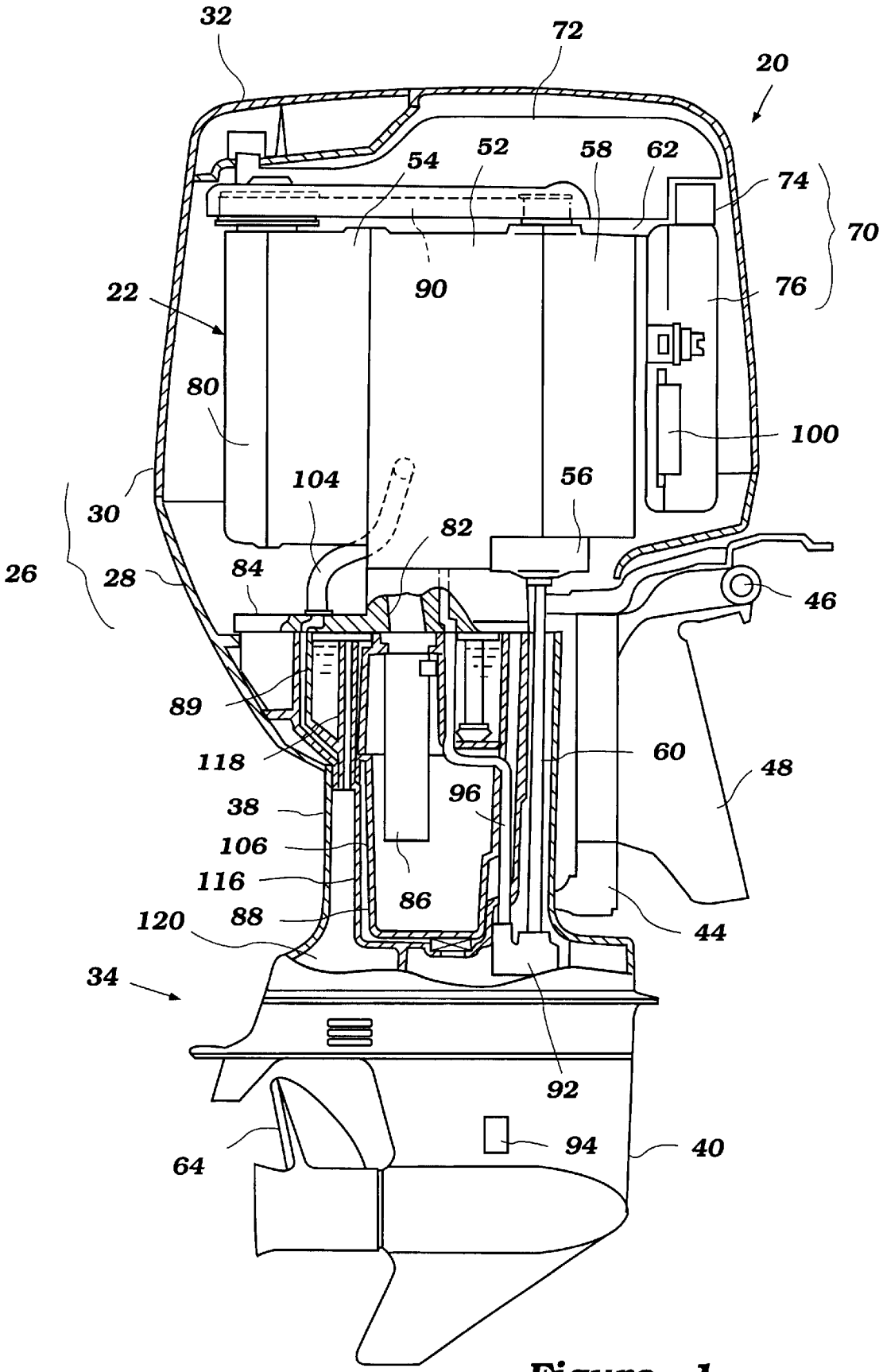
FIG. 1 is a cross-sectional side view of an outboard motor having a water propulsion device powered by an engine positioned in a cowling of the motor, the motor having a cooling system arranged in accordance with the present invention.

In accordance with the present invention, and referring generally to FIG. 1, there is provided a cooling system for an outboard motor 20. The cooling system is preferably arranged to maintain coolant within one or more cooling passages for cooling the engine after the engine has stopped running. The cooling system of the present invention is described for use in cooling an outboard motor 20 since this is an application for which the cooling system has particular advantages. Those of skill in the art will appreciate that the cooling system may be adapted for use in a variety of other applications.

Referring to FIG. 1, the outboard motor 20 has a powerhead 26 comprised of a lower tray portion 28 and a main cowling portion 30. An engine 22 is positioned in the powerhead 26 of the motor 20. An air inlet 32 is provided in the main cowling portion 30 for providing air to the engine 22 therein. The motor 20 includes a lower unit 34 extending downwardly from the cowling portion 30. The lower unit 34 comprises an upper or "drive shaft housing" section 38 and a lower section 40.

The motor 20 is arranged to be movably mounted to a watercraft (not shown). Preferably, the motor 20 is connected to a steering shaft (not shown). The steering shaft is supported for steering movement about a vertically extending axis within a swivel or swivel bracket 44. The mounting of the motor 20 via the steering shaft with respect to the swivel bracket 44 permits the motor 20 to be rotated about the vertically extending axis through the swivel bracket 44.

In this manner, the motor 20 may be turned to direct the watercraft, which it is used to propel.

The swivel bracket 44 is connected by means of a pivot pin 46 to a clamping bracket 48, which is adapted to be attached to a transom portion of a hull of a watercraft. The pivot pin 46 permits the outboard motor 20 to be trimmed and tilted up about the horizontally disposed axis formed by the pivot pin 46.

Referring to FIG. 1, the powerhead 26 of the outboard motor 20 includes the engine 22, which is positioned within the main cowling portion 30. The engine 22 is preferably of the four-cylinder variety, arranged in in-line fashion and operating on a four-cycle operating principle. As may be appreciated by those of skill in the art, the engine 22 may have a greater or lesser number of cylinders, such as two, six, or eight or more. In addition, the engine 22 may have its cylinders arranged in "V", opposing or other arrangements, and the engine 22 may operate on a two-cycle or other principle.

In the preferred arrangement, the engine 22 has a cylinder block 52 with a cylinder head 54 connected thereto and cooperating therewith to define the four cylinders. Though not illustrated, a piston is movably positioned in each cylinder, and connected to a connecting rod extending to a vertically extending crankshaft 56. Referring to FIG. 1, the crankshaft 56 is arranged to drive a drive shaft 60, which extends downwardly through the lower unit 34, where it is arranged to drive a water propulsion device of the motor 20.

Preferably, this water propulsion device comprises a propeller 64. The propeller 64 is preferably driven by the drive shaft 60 through a conventional forward-neutral-reverse transmission. The transmission is not illustrated herein, as its construction per se forms no part of the invention. Therefore, any known type of transmission may be employed. A control is preferably provided for allowing an operator to remotely control the transmission, such as from the watercraft.

The crankshaft 56 is journalled for rotation with respect to the cylinder block 52. A crankcase cover 58 engages an end of the block 52, defining therewith a crankcase 62 within which the crankshaft rotates. The crankcase cover 58 may be attached to the cylinder block 52 by bolts or similar means for attaching (not shown), as known to those skilled in the art.

The engine 22 includes an air intake system for providing air to each cylinder. As illustrated in FIG. 1, air passes through the intake 32 in the motor cowling 30 and through an air plenum 72 to an intake pipe 74. As illustrated, this air plenum 72 extends over a top end of the engine 22 within the cowling 30 from the rear of the engine 22 towards a front of the engine.

The intake pipe 74 extends downwardly to at least one surge tank 76. Though not shown, at least one air delivery passage leads from the surge tank 76 to each cylinder for providing air thereto.

As well known to those of skill in the art, means are provided for controlling the flow of air into each cylinder. This means may comprise at least one intake valve arranged to selectively open and close the air delivery passage leading to each cylinder. The valves are preferably moved with at least one camshaft (not shown) rotatably connected to the cylinder head 54 and positioned under a camshaft cover 80 connected to the cylinder head 54.

An exhaust system is provided for routing the products of combustion within the cylinders to a point external to the engine 22. Preferably, an exhaust passage (not shown) leads from each cylinder into a main exhaust passage defined by the engine 22, which extends to a bottom end of the engine 22. This main exhaust passage is aligned at the bottom end of the engine 22 with an aligned passage 82 in an exhaust guide 84 positioned at the bottom end of the engine 22.

An exhaust pipe 86 extends downwardly from the passage 82 in the exhaust guide 84. The exhaust pipe 86 terminates in an expansion chamber 88 positioned within the drive shaft housing portion 36 of the lower unit 34. Exhaust is preferably routed from the expansion chamber 88 to a point external to the motor 20, such as through a through-the-propeller hub discharge passage.

Means are also provided for controlling the flow of exhaust from each cylinder to its respective exhaust passage. This means may comprise at least one exhaust valve as well known to those of skill in the art. Like the intake valves, the exhaust valves may be actuated by a camshaft journalled for rotation with respect to the cylinder head 54 and enclosed within the camshaft cover 80.

When at least one camshaft is used to drive intake and/or exhaust pulleys, means are also provided for rotating the camshaft(s). As best illustrated in FIG. 1, this means may comprise a flexible transmitter such as a belt 90 driven by the camshaft 56 and driving the camshaft(s).

A fuel delivery system is provided for delivering fuel to each cylinder for combustion therein. The fuel delivery system preferably includes a fuel tank (not shown) and a fuel pump (not shown) for pumping fuel from the tank and delivering it to at least one charge former (such as a fuel injector or carburetor, not shown) which delivers fuel to each cylinder. The fuel system may be arranged in a variety of manners known to those of skill in the art.

A suitable ignition system is provided for igniting an air and fuel mixture within each cylinder. Such systems are well known to those skilled in the art, and as the ignition system forms no part of the invention herein, such is not described in detail here.

The motor 20 includes a lubricating system for lubricating various parts of the engine 22. Preferably, the lubricating system includes an oil pan or tank 89 positioned below the engine 22 and preferably attached to the exhaust guide 84. Lubricant is drawn from the tank 89 by a lubricant pump (not shown) and delivered to one or more parts of the engine 22 before returning to the tank 89 through one or more return or drain passages.

In accordance with the present invention, the motor 20 includes a cooling system. The cooling system is preferably arranged to cool the engine 22 with cooling liquid, preferably in the form of water from the body of water in which the motor 20 is positioned. Means are provided for delivering this cooling water to the engine 22. Preferably, this means comprises a water pump 92.

As best illustrated in FIG. 1, the water pump 92 is and positioned in the lower unit 34. The pump 92 is preferably driven by the drive shaft 60, and draws water from the body of water in which the motor 20 is operating through an intake pipe 95 (see FIG. 2) from an inlet 94, and expels it upwardly through a cooling liquid supply pipe 96.

Figure 2:
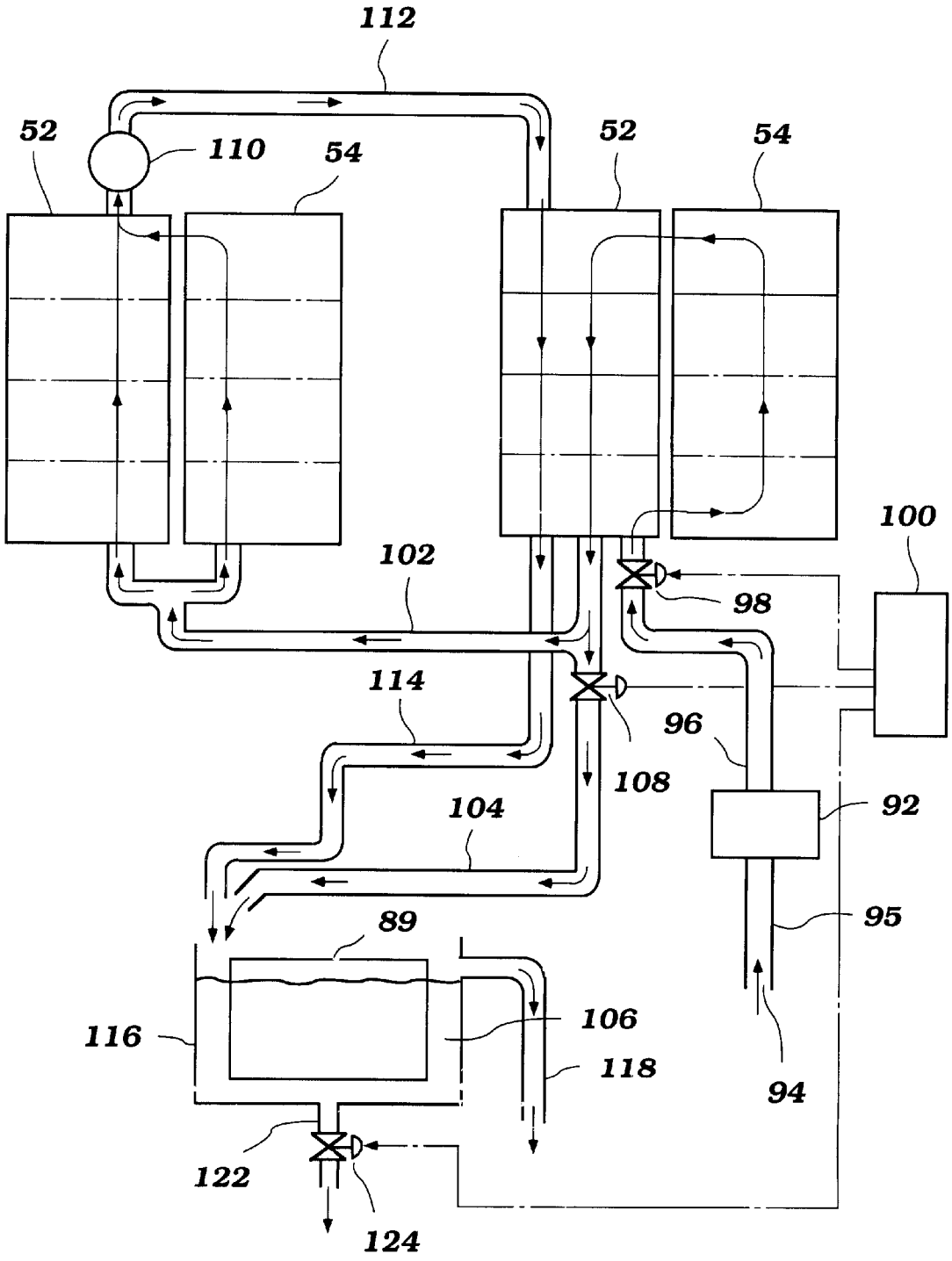
FIG. 2 is schematic illustrating the cooling system of the outboard motor illustrated in FIG. 1.

Referring to FIG. 2, the cooling system is illustrated in more detail. As illustrated therein, the cooling liquid delivered through the supply pipe 96 selectively passes through a first cooling path formed through the cylinder head 52 and block 54. Preferably, means are provided for controlling the flow of cooling liquid passing through the pipe 96. As illustrated, this means comprises a first valve 98.

Means are provided for controlling the first valve 98 so as to selectively permit cooling liquid to flow into the engine 22 and to prevent the reverse flow of coolant in the engine 22 back towards the pump 92. Preferably, this means comprises an electronic control unit 100 arranged to control an electrically powered actuator associated with the valve 98.

The cooling liquid, which is permitted to flow through the valve 98 preferably, flows first through the cylinder head 54 and then through the cylinder block 52. Preferably, the coolant path through this portion of the block 52 and head 54 is for cooling primarily that portion of the cylinder head 54 defining the exhaust passages therethrough, and that portion of the block 52 defining the main exhaust passage leading to the passage 82 through the exhaust guide 84.

The cooling liquid then selectively flows through a first re-delivery line 102 to a second cooling liquid path through the engine 22, or through a first return line 104 to a coolant pool 106.

Means are provided for controlling the flow of cooling liquid through the return line 104. Preferably, this means comprises a second valve 108 positioned along the return line 104. The second valve 108 is arranged to selectively permit cooling liquid to flow through the return line 104.

Means are provided for controlling the second valve 108. Preferably, this means comprises the same electronic control unit 100, which is used to control the first valve 98.

The cooling liquid which flows through the first re-delivery line 102 is preferably divided and flows through a second flow path through the cylinder block 52 and head 54.

Means are preferably provided for preventing the flow of cooling liquid along the second flow path through the cylinder block 52 and head 54. Preferably, this means comprises a thermostat 110 positioned along the coolant path. As illustrated, the thermostat 110 is positioned along a second re-delivery line 112, which extends from the second coolant paths through the cylinder block 52 and head 54 to a third coolant path through the cylinder block 52 only.

The thermostat 110 is preferably arranged to close and prevent the flow of cooling liquid through the second re-delivery line 112 when the temperature of the engine 22 (and thus the cooling liquid) is low, permitting the engine to warm up. On the other hand, when the temperature of the engine 22 is high, the thermostat 110 opens, permitting cooling liquid to flow therethrough and cool the engine 22.

When the thermostat 110 is open and the second valve 108 is positioned to divert cooling liquid to the first re-delivery passage 102, cooling liquid flows through the second coolant path through the cylinder block 52 and head 54 and through the second re-delivery passage 112. This cooling liquid flows through the third coolant path through the engine 22, which preferably passes through the cylinder block 56 only. The cooling liquid is then routed through a second return line 114 to the coolant pool 106.

As illustrated in FIG. 1, the coolant pool 106 is formed in a space between a wall 116 and a wall, which defines the oil pan 89. The cooling liquid in the cooling pool 106 thus cools the lubricant in the oil pan 89.

Means are provided for selectively permitting the cooling liquid, which flows through the return lines 104, 114 to the pool 106 to selectively fill the coolant pool. Preferably, this means comprises a valve 124, which controls the flow of cooling liquid through a bottom drain 122. The bottom drain 122 is a passage leading through the wall 116 at or near its lowest point within the lower unit 34.

Means are provided for controlling the drain valve 124 between a first position in which cooling liquid is permitted to flow through the drain 122 and a second position in which the drain 122 is closed and the cooling liquid fills the coolant pool 106. Preferably, this means comprises the electronic control unit 100.

When the drain valve 124 permits cooling liquid to flow through the drain 122, the coolant pool 106 does not fill with coolant, and instead the cooling liquid drains therethrough and is preferably routed back to the body of water in which the motor 20 is operating.

When the drain valve 124 prevents cooling liquid to flow through the drain 122, the cooling liquid fills the coolant pool 106. When the coolant pool 106 is full, cooling liquid is diverted therefrom through an overflow line 118. Preferably, the cooling liquid flows over a weir into the overflow line 118, which extends downwardly to a drain area 120 in the lower unit 34, which leads to a point external to the motor 20.

As stated above, the control unit 100 is arranged to control the position of the first, second and drain valves 98, 108, 124. In accordance with the present invention, the control unit 100 is arranged to control these valves as follows.

Preferably, the control unit 100 is arranged to control the valves 98, 108, 124 to prevent the coolant from draining from at least some of the coolant passages through the engine 22 and most preferably also from the pool 106 surrounding the oil pan 89 when the engine is stopped. In a first arrangement, the valves 98, 108, 124 are closed to prevent the coolant from draining from the coolant passages through the engine 22 and the coolant pool 106 until a fixed period of time after the engine has been stopped.

In a second arrangement, the valves 98, 108 are closed to prevent the coolant from draining from the coolant passages through the engine 22 and the coolant pool 106 until the temperature of the engine 22 is cools at or below a predetermined temperature, such as to the ambient air temperature. In this arrangement, a temperature sensor (not shown) preferably provides a signal to the control unit 100. In this arrangement, the temperature of the air within the cowling 30 may be sensed instead of the temperature of the engine 22.

In accordance with the present invention, when the engine 22 is stopped, coolant is retained in the coolant pool 106 and the coolant passages through the engine 22 until the engine 22 has cooled down. In this manner, the cooler coolant absorbs heat from the engine 22 and the lubricant, preventing its immediate transmission to the engine accessories and air within the cowling 30. The rate of heat transmission to these components is thus reduced when the engine is stopped, as compared to the situation in which the coolant is permitted to drain from the engine, keeping the temperature of the air in the cowling, and thus the engine accessories and features low.

Those of skill in the art will appreciate that the above-described coolant flow path through the engine 22 is a preferred flow path and that the present invention may be adapted to cooling systems having flow paths which differ from that described above.

In addition, the cooling system may be of a closed-loop type in which coolant is circulated from a coolant supply tank through the engine. Those of skill in the art will appreciate that the present invention may be adapted to such a system to prevent the coolant from draining to the tank when the engine is stopped.

Of course, the foregoing description is that of preferred embodiments of the invention, and various changes and modifications may be made without departing from the spirit and scope of the invention, as defined by the appended claims.

What is claimed is:

1. An outboard motor having a water propulsion device and an internal combustion engine positioned in a cowling, the engine having an engine body assembly defining at least one cylinder, an air delivery system for delivering at least an air charge to said cylinder and an exhaust system for discharging a burnt charge from said cylinder to the atmosphere, said exhaust system including an exhaust passage for collecting the exhaust gasses from said cylinder, said engine further comprising an output shaft arranged to drive said water propulsion device, and a cooling system for said engine including a coolant delivery mechanism driven by said engine for drawing water from a body of water in which said outboard motor is operating and returning the drawn water back to the body of water, said cooling system comprising a first coolant path for cooling said cylinder and a second coolant path for cooling primarily said exhaust passage, said delivery mechanism arranged to deliver coolant through said second coolant path and directly therefrom to a coolant drain, said delivery mechanism arranged to deliver coolant through said first coolant path to said coolant drain, and means for controlling the flow of coolant from said engine through said first and second coolant paths comprising first and second control valves disposed at respective downstream ends of said first and said second coolant paths for controlling the respective flow therethrough independently of fluid pressure.

2. The outboard motor cooling system in accordance with claim 1, wherein at least one of said control valves comprises a temperature responsive valve.

3. The outboard motor cooling system in accordance with claim 1, wherein one of said control valves includes a control unit for moving said one control valve between a first position in which coolant is permitted to flow through said coolant drain and a second position in which coolant is prevented from flowing through said coolant drain.

4. The outboard motor cooling system in accordance with claim 1, wherein said motor further includes an oil pan for supplying recirculated oil for lubrication of said internal combustion engine, said cooling system further including a coolant portion in heat exchanging relation to at least a portion of said oil pan for cooling oil in said pan.

5. The outboard motor cooling system in accordance with claim 4, wherein the coolant portion of said oil pan discharges through said coolant drain.

6. The outboard motor cooling system in accordance with claim 1, wherein said coolant delivery mechanism comprises a coolant pump powered by said output shaft of said engine.

7. The outboard motor cooling system in accordance with claim 1 wherein the engine body is comprised of at least a cylinder block and a cylinder head.

* * * * *